United States Patent [19]

Hendricks

[11] Patent Number: 4,917,627

[45] Date of Patent: Apr. 17, 1990

[54] LATCH REPLACEMENT KIT

[75] Inventor: Charles E. Hendricks, St. Clair Shores, Mich.

[73] Assignee: Chrysler Corporation, Highland Park, Mich.

[21] Appl. No.: 344,924

[22] Filed: Apr. 28, 1989

[51] Int. Cl.[4] ..... H01R 13/627

[52] U.S. Cl. ..... 439/371; 439/357; 439/464; 24/665; 24/682

[58] Field of Search ..... 439/345, 350, 357, 358, 439/296, 300, 369, 371, 470, 471, 484; 24/664, 665, 682

[56] References Cited

U.S. PATENT DOCUMENTS 3,544,951 12/1970 Roberts ..... 439/358

3,828,302 8/1974 Cieniawa et al. ..... 439/357

*Primary Examiner*—Eugene F. Desmond

*Assistant Examiner*—Walter G. Hanchuk

*Attorney, Agent, or Firm*—Wendell K. Fredericks

[57] ABSTRACT

A latch replacement kit for replacing a latch of a damaged in-line connector lock.

The kit contains a replacement latch assembly that has a grooved track in which a tie strap routes for tying the latch assembly to the connector.

1 Claim, 1 Drawing Sheet

LATCH REPLACEMENT KIT

BACKGROUND OF THE INVENTION

1. Field of Invention:

The present invention is in the field of electronic connectors and specifically discloses a kit for replacing a latch of a damaged connector lock. The present invention is specifically designed to be useful in applications wherein an in-line socket is locked to an in-line plug by a connector lock and it is important to keep the socket locked to the plug with the latch lock.

2. Background of the Invention:

Certain cable connector assemblies require locks to keep a plug in place in a socket. A catch is mounted to the plug, and a latch is placed above the entrance of the socket. The lock normally has a raised key slot for receiving the catch of the plug. A resilient latch fixed at one end of the lock has a slot that encompasses the catch after the catch passes through the key slot. The catch has a front face that is wedged so as to encounter a front structure of the latch and to raise the front structure in order for the catch to move into the slot.

Often it is necessary to remove the plug from the socket. To do so, the catch must be removed from the slot. The front structure of the latch must be raised in order to extract the catch from the slot. In raising the latch at the front structure, sometimes the latch fractures at the fixed end detaching the latch from the housing. Means must be provided to repair or replace the latch.

Repairs sometimes consist of taping the plug to the socket. Other times tic straps are used to tie the plug to the socket. Many of the repair schemes have worked but have been inefficient. Hence, a search was made to find a repair technique that would e effective and efficient. This search resulted in the latch repair kit of the present invention.

SUMMARY OF THE INVENTION

The present invention relates to a latch repair kit for repairing the latch used to lock the plug in a socket in an in-line connector assembly. The replacement latch assembly includes a latch fixedly attached to a mounting bracket. The mounting bracket has a grooved track for receiving a tie strap. The replacement latch assembly is designed to confluence and mate with the damaged lock housing in a manner permitting locking the catch in a slot of the latch similar to the original part.

IN THE DRAWINGS

DESCRIPTION OF THE PREFERRED EMBODIMENT

Figure 1A:
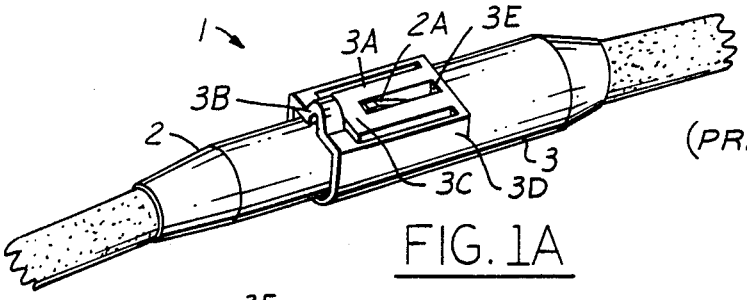
FIG. 1A is a perspective view of an in-line connector assembly of the prior art that employs a lock for locking a plug in a socket of the connector assembly.

Referring to FIG. 1A, the illustration depicts a conventional in-line connector assembly. A plug 2 with a catch 2A embedded on the barrel shaped housing inserts into socket 3 and held in place by the latch 3A encompassing the catch 2A. Latch 3A has a front structure 3C and socket 3 has a key slot 3B and a key slot 3B that has a profile of the catch for guiding a front wedge edge of the catch 2A under the front structure 3C of latch 3A, the rear end of the latch being fixedly attached to the lock housing 3D. The latch made from a resilient material flexes upward as the wedge edge of the catch is urged under the front structure. The latch 3A has a slot 3E co-extensive with the length of the catch for receiving the catch and locking a rear face of the catch against a front edge of the slot.

If it is desired to remove the plug 2 from the socket 3 by unlocking the lock, the rear edge of the slot 3E must be raised over the rear face of the catch. To do this, the latch must be flexed upwardly to a height suitable for withdrawing the catch from the slot. Now the plug can be withdrawn from the socket. If the latch is flexed excessively, the rear end of the latch will sever from the lock housing as shown in FIG. 1B.

Figure 1B:
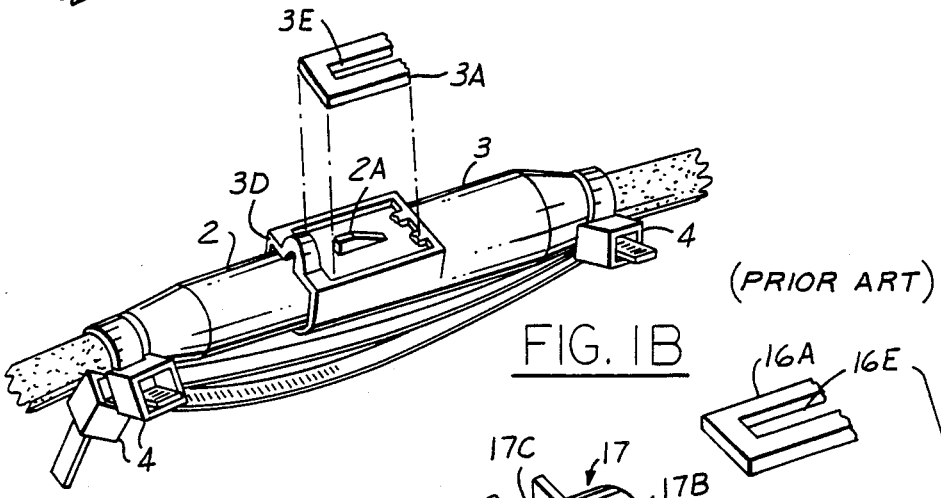
FIG. 1B depicts a broken latch of the lock and a plurality of tie straps for locking the plug to the socket using prior art techniques.

FIG. 1B depicts a latch 3A severed from the lock housing 3D and a prior art multiple tie strap fix employed to lock the plug in socket 3. Note that three tie straps are used to lock the plug to the socket.

Another fix may require taping the plug in the socket which, in most cases, is an unsatisfactory solution.

Figure 1:
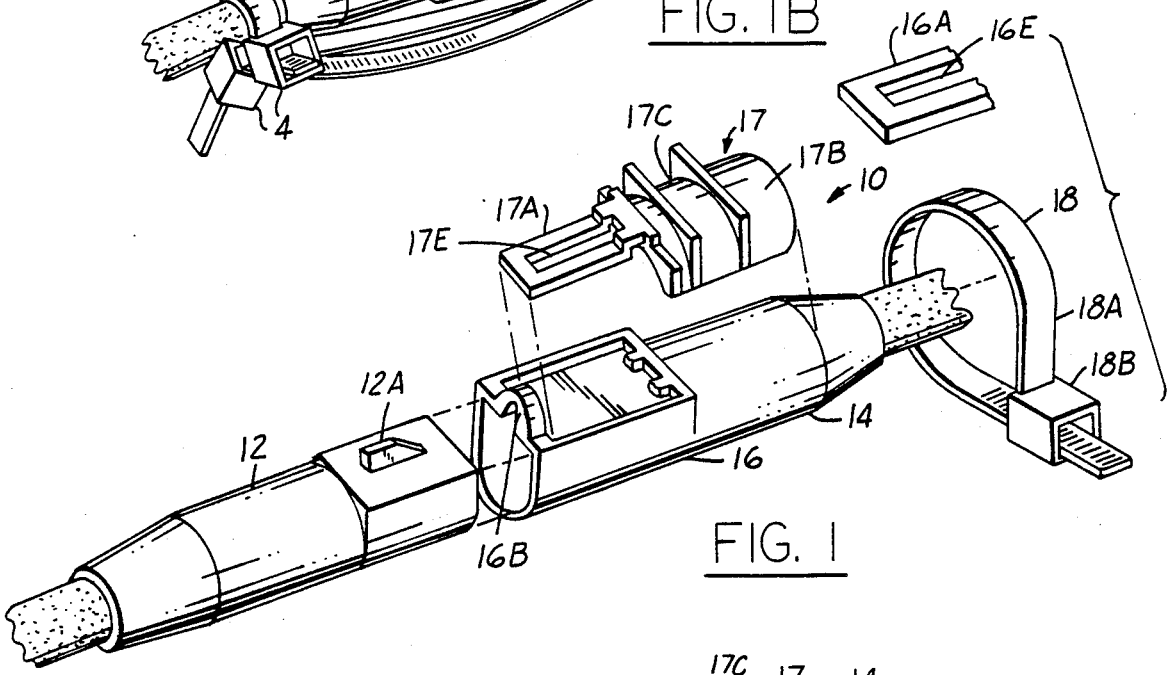
FIG. 1 depicts the components of the replacement latch assembly kit of the present invention spaced apart from a damaged lock housing and the alignment of the components prior to kit assembly.

Referring now to the present kit embodiment, FIG. 1 illustrates a plug connector 12 with a catch 12A of lock 16 embedded to one end and a socket connector 14 with a latch 16A detached from the housing of the lock. The lock 16 includes a key hole slot 16B having the profile of the catch 16D used to guide the catch into a slot 16E of the latch 16A.

FIG. 1 also shows the replacement latch assembly 17 that includes a semi-circle mounting bracket 17B that mounts at the rear of the lock housing. The bracket 17B has a semicircle grooved track 17C about the circumference of the bracket 17B for routing a strap 18A of tie strap 18 about the bracket and the connector for locking the replacement latch assembly 17 to the connector 14.

Extending from the bracket, resilient replacement latch 17A fixedly mounts to a front edge of the bracket such that the replacement latch 17A extends over an edge of housing of the lock so as to replace the detached latch 16A of the damaged lock 16.

Figure 2:
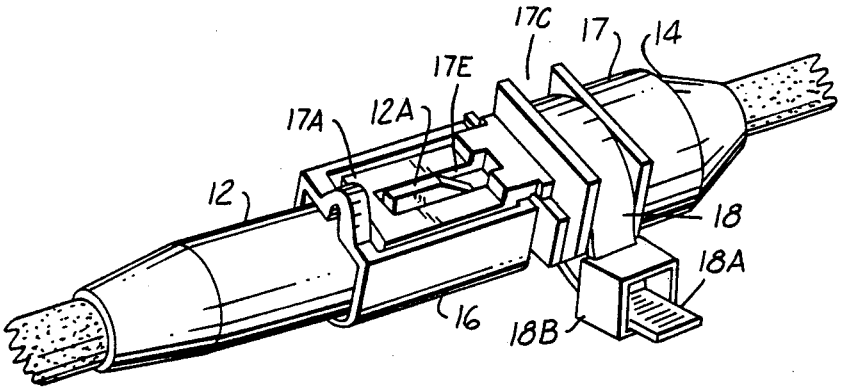
FIG. 2 illustrates the replacement latch assembly kit attached to the damaged lock housing and functioning normal to lock the plug to the socket.

FIG. 2 depicts the replacement lock assembly 17 with the replacement latch 17A with a slot 17E that encompasses the catch 12A of the plug connector 12. The tie strap 18 wraps around the mounting bracket l7B in the groove l7C and the barrel shaped surface connector 14 and is locked in place by strap lock 18B.

The replacement lock assembly 17 and tie strap 18 form the latch repair kit used to repair damaged locks with detached latches. This kit permits normal lock functions of the lock to occur. The plug connector 12, with catch 16D attached, plugs into socket connector 14. The replacement latch 17A flexes to allow the front wedge of the catch 12A to raise the front structure of the latch so that the catch may come to rest in the slot 17E locking the rear flat face of the catch against the front edge of slot 17E locking the plug connector 2 in socket connector 14 in a similar manner as the original mating parts.

I claim:

1. A kit for repairing a damaged latch of a connector assembly lock wherein a barrel-type plug of one connector which contains a catch of the lock inserts into a socket of another barrel-type connector containing a latch of the lock, the lock includes a key hole having the profile of the catch for receiving the catch and a latch fixedly attached to the rear portion of the lock, the latch having a front structure and a slot, the front structure rising sufficiently to allow a front wedge surface of the catch being urged through the key hole to enter the slot, the slot encompassing the catch such that a rear flat face of the catch abuts against the front structure locking the plug connector in the socket connector wherein a damaged latch occurring if the latch is raised excessively such that the latch severed from the rear portion of the lock leaving a damaged lock housing, said kit comprising:

a replacement latch assembly comprised of:

(1) a mounting bracket that encompasses the socket connector near a rear location of the damaged lock, said mounting bracket having a grooved track extending over the surface of the bracket;

(2) a resilient replacement latch fixedly attached to a front edge of said mounting bracket such that said latch extends over the housing of the lock and in the lock housing so as to be in a position to replace the detached latch of the damaged latch, said replacement latch having slot for receiving the catch; and (3) a tie strap comprised of a strap and a strap lock, the strap routing in the track and about the socket connector and through the strap lock, locking said bracket in place against the socket connector such that the replacement latch confluences with the catch and the damaged lock housing.

* * * * *